United States Patent [19]

Logan

[11] Patent Number: 4,910,871

[45] Date of Patent: Mar. 27, 1990

[54] CALLIGRAPHY MACHINE AND RELATED METHOD OF OPERATION

[75] Inventor: David J. Logan, Glastonbury, Conn.

[73] Assignee: Gerber Scientific Products, Inc., Manchester, Conn.

[21] Appl. No.: 312,080

[22] Filed: Feb. 16, 1989

[51] Int. Cl.[4] ..... B43I 11/00

[52] U.S. Cl. ..... 33/18.2; 346/139 R

[58] Field of Search ..... 33/18.1, 18.2, 614, 33/622, 623; 346/139 R; 400/118, 16, 17, 18, 19

[56] References Cited

U.S. PATENT DOCUMENTS

| | | | |
|---|---|---|---|
| 4,467,525 | 8/1984 | Logan | 33/18.2 |
| 4,532,521 | 7/1985 | Onoda et al. | 346/139 R |
| 4,668,963 | 5/1987 | Tanabe et al. | 33/182 X |

*Primary Examiner*—Harry N. Haroian

*Attorney, Agent, or Firm*—McCormick, Paulding & Huber

[57] ABSTRACT

An apparatus and method for arranging and printing data containing a single line or a plurality of lines of text on a work piece utilizes a controller, a feeding mechanism and a printer to move the work piece from a receiving position to a printing position where the data is formed by printing on one face of the work piece. The feeding mechanism aligns an otherwise skewed work piece before the printing operation and thereafter the height and the width of the work piece are automatically determined. The data arranged on the work piece is both sized and located in dependance on the dimensions of the work piece and the amount of data to be printed.

36 Claims, 5 Drawing Sheets

CALLIGRAPHY MACHINE AND RELATED METHOD OF OPERATION

BACKGROUND OF THE INVENTION

The present invention resides in a calligraphy machine, and a related method, for receiving and printing on variously sized work pieces information input to the machine by an operator, and deals more particularly with a machine and method for neatly printing on the face of variously sized envelopes, or similar work pieces, information such as mailing and return addresses and/or other expressions input to the machine by the operator, preferably in a style of lettering selected prior to the printing operation by the operator from a given number of styles made available for choice.

It is generally recognized that in addressing envelopes enclosing correspondence, such as formal invitations or greeting cards, it is often desirable to exhibit neatness and care in the formation of the lettering comprising the address and return address written on the face of the envelope, so as to create a pleasing, aesthetic appearance. In the case of wedding invitations for example, the mailing address and the return address on the forwarding envelopes are often handscribed by a calligrapher to create an impression of formality or honor when received by the invitee. However, hand calligraphy consumes a great amount of time on the part of a skilled calligrapher and in addition to being expensive the sender has to have the work started well in advance of the mailing date to allow the calligrapher to have all envelopes addressed in time.

In a case where greeting cards or less formal items are being sent, the use of calligraphy for addressing envelopes adds an additional touch to correspondence not achieved by handwriting the addresses in an ordinary way. In the situation where a card enclosed within an envelope is given in person rather than mailed to a recipient, it may be desirable to express on the envelope face the giver's sentiments by using such expressions as "Happy Anniversary" or "Happy Birthday". When such expressions are written with an ordinary hand they may not make the intended impression and may be out of keeping with the artistic presentation made by the enclosed card. Therefore, it would be desirable in many instances to have an address or expression printed on an envelope face in an aesthetically pleasing format and lettering style.

Envelopes used with greeting cards, invitations and the like are provided in many different sizes within the maximum and the minimum dimensions acceptable for regular mailing by the postal service. A problem with creating artistic lettering on envelopes which may be of variable size is that the aesthetic benefit obtained by forming ornate lettering depends to a large degree upon the proportional sizing and location of such lettering in relation to the actual dimensions of the involved envelope. That is, for each size envelope a corresponding lettering size should be used for best results. Also, where the envelopes or similar articles to be handled and printed upon do vary in size, the apparatus for receiving and printing these envelope articles should be able to easily accommodate such size variances.

Therefore, it is the object of the present invention to provide a machine capable of receiving variously sized envelopes or similar work pieces and for printing, preferably in a selectable style of letters, on each work piece information input by an operator into the machine in a letter size and layout determined by and aesthetically related to the size of the work piece.

It is yet another object of the present invention to provide a machine of the aforegoing character capable of receiving an envelope or similar work piece presented to the machine in somewhat non-precise orientation and of then automatically positioning the work piece in a proper orientation for printing.

A further object of the invention is to provide a machine of the aforegoing character capable of automatically measuring, prior to printing, both the width and the height of a work piece inserted into the machine and of subsequently using the height and width information so obtained to influence the size and layout of the characters printed on the work piece face.

Yet a further object of the invention is to provide a machine of the aforegoing character having a keyboard or other manually operable data input means for receiving data to be printed on the work piece face.

A further object of the invention is to provide a machine of the aforegoing character which allows an operator to select, for the printing of an envelope or other work piece placed into the machine, a style of lettering from a number of lettering styles made available for choice.

Yet a further object of the invention is to provide a method for operating a machine of the aforegoing character so as to cause the machine to automatically lay out and size the data input to the machine according to the dimensions of the involved work piece.

Other objects and advantages of the invention will be apparent from the following detailed description of a preferred embodiment and from the accompanying drawings and claims.

SUMMARY OF THE INVENTION

The invention resides in a calligraphy machine and method for receiving one at a time variously sized work pieces and for moving each such work piece toward a printer having a printing station. As the work piece is moved toward the printing station it is automatically orientated, if necessary, to a predetermined orientation and its width and length and lateral position are also automatically determined. This width, length and lateral position information is then used to automatically position relative to the work piece face the block or blocks of text printed on that face by the printer. More specifically, the invention resides in the machine including a generally horizontal receiving surface, having spaced first and second ends, and a drive means located between those ends and engageable with one face of the work piece to move it along the receiving surface. An abutment means is positioned near the second end of the receiving surface and is located along a line extending transversely of the receiving surface, the work piece being driven against the abutment means as it is moved along the receiving surface by the drive means. The drive means consists of a plurality of spaced drive wheels mounted on a common shaft and each driven by the shaft through a frictional coupling, so that with accompanying slippage relative to the drive shaft of one or more of the drive wheels engaging the work piece, if the work piece is inserted crookedly into the machine, the leading edge of the work piece will eventually become aligned with said line along which the abutment means is located. A first row of photodetectors arranged on a line near and parallel to the abutment line detects the fact of the leading edge of the workpiece becoming aligned with the abutment line, and in response to this detection the work piece and the abutment means are moved out of coengagement with one another to allow the work piece to advance beyond the abutment means to the printing station. At this time a second row of closely spaced photodetectors extending transversely across the receiving surface and spaced a short distance in advance of the abutment line is interrogated to determine the width of the work piece and its lateral position on the receiving surface. Then after the work piece and abutment means are disengaged from one another the work piece is advanced by a step motor driven drive means to the printing station, and the height of the envelope is determined by counting the step motor pulses needed to advance the envelope from the position at which its leading edge is aligned with the abutment line to the position at which its trailing edge aligns with the second row of photodetectors.

The invention also resides in sizing and arranging characters to be printed on a work piece using the width, height and lateral position information derived from the aforesaid photodetectors and step motor pulse count. In a more specific aspect the invention resides in the steps of determining an imaginary text block or blocks having height and width dimensions proportionally related to the height and width dimension of the work piece and then successively determining the height and width of the text to be entered in such blocks at decreasing character sizes until the text is found to fit with the imaginary blocks. The invention also resides in a block or blocks of text being located on the work piece face in dependance on the measured work piece height and width.

DETAILED DESCRIPTION OF THE PREFERRED EMBODIMENT

Figure 1:
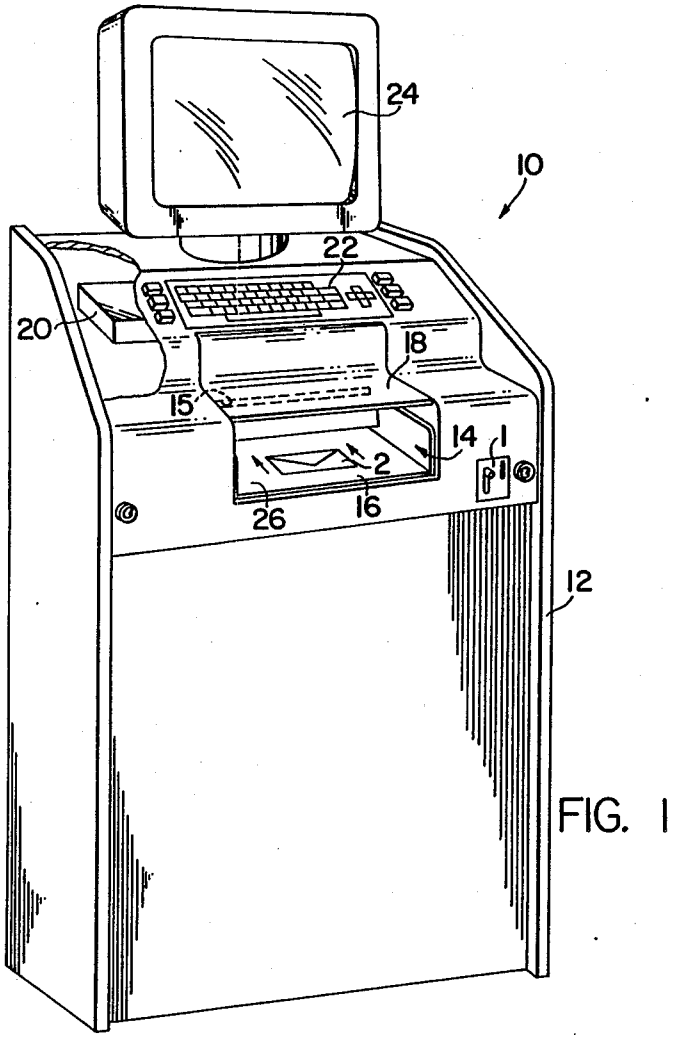
FIG. 1 is a perspective view of a calligraphy machine embodying the invention.

FIG. 1 illustrates a calligraphy machine embodying the present invention and designated generally 10. It includes a cabinet-like base 12 supporting a receiving means 14 for receiving, one at a time, generally rectangular flat flexible work pieces hereinafter taken to be envelopes such as the illustrated envelope 2. This receiving means includes a receiving tray 16 having a generally horizontal receiving surface 26 accessible to the user at the front of the machine and covered along most or all of its extent by a transparent cover 18 allowing a user to see through to the tray 16 while entering a work piece 2. The machine 10 also includes a controller 20 having a keyboard 22 for manually entering data to be printed on the involved envelope 2, this controller 20 including a microprocessor for use, among other things, in sizing and laying out the data in accordance with the formatting scheme comprising part of the invention and explained in detail hereinafter. The controller 20 has a CRT screen 24 for displaying processor generated input requests and prompts and for subsequently displaying back to the operator the entered text data so that he or she may see and correct any portion of such data, using the keyboard 22, prior to the text being printed on the work piece 2. The machine may be placed in a retail environment, such as a greeting card shop, and therefore as illustrated it may be designed to be operated on a pay-as-used basis using a coin box 1 or other suitable fee collecting device.

In using the machine 10 an envelope 2 to be printed on is entered into the machine by placing it face down on the receiving surface 26 so that the envelope flap is positioned upwardly and pointing back toward the user. It is then moved forwardly, toward the machine, by the user until the feeding mechanism of the machine grabs hold of it and thereafter automatically moves it through the machine. At the end of the machine's handling of the envelope it is returned to the user through a discharge slot 15 located slightly above the receiving surface 26, and under the cover 18, so that the envelope falls onto the receiving surface and is held by it until retrieved by the user.

Figure 2:
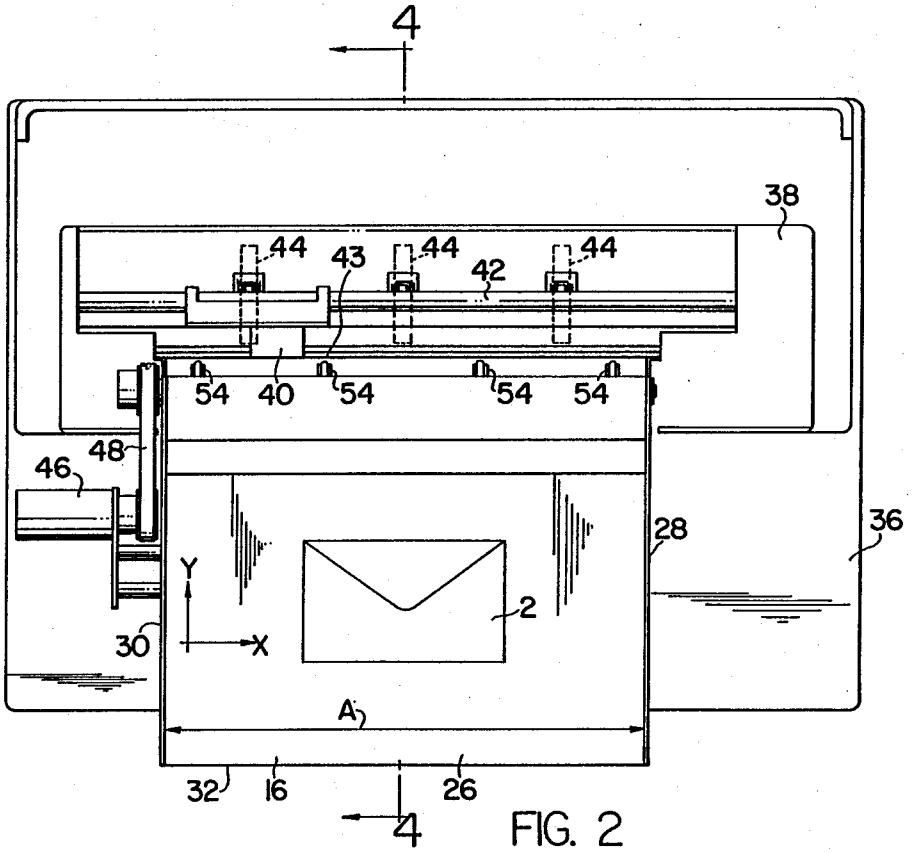
FIG. 2. is a plan view of the machine of FIG. 1 showing the printer and the receiving station of the machine apart from the base.
Figure 3:
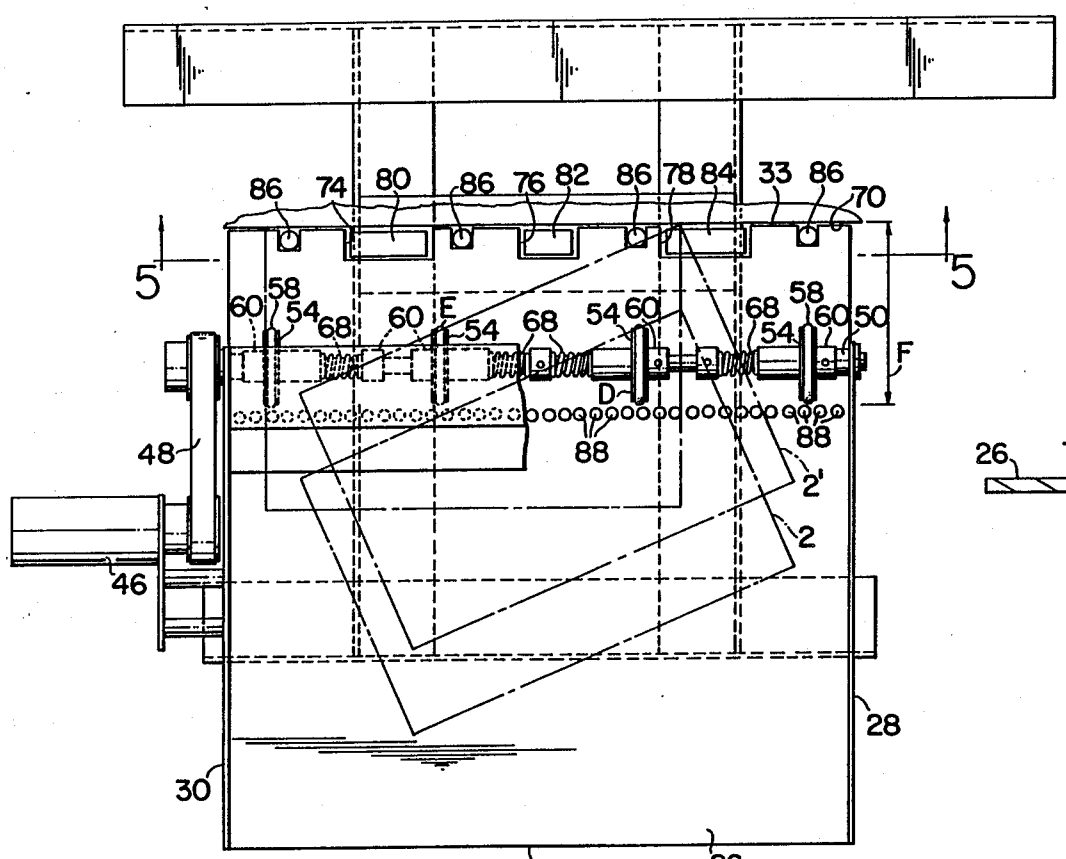
FIG. 3 is top plan view of the receiving station absent the printer and shows in phantom line the positioning sequence of an envelope, initially placed crookedly on the receiving surface, as it is fed into the machine.
Figure 4:
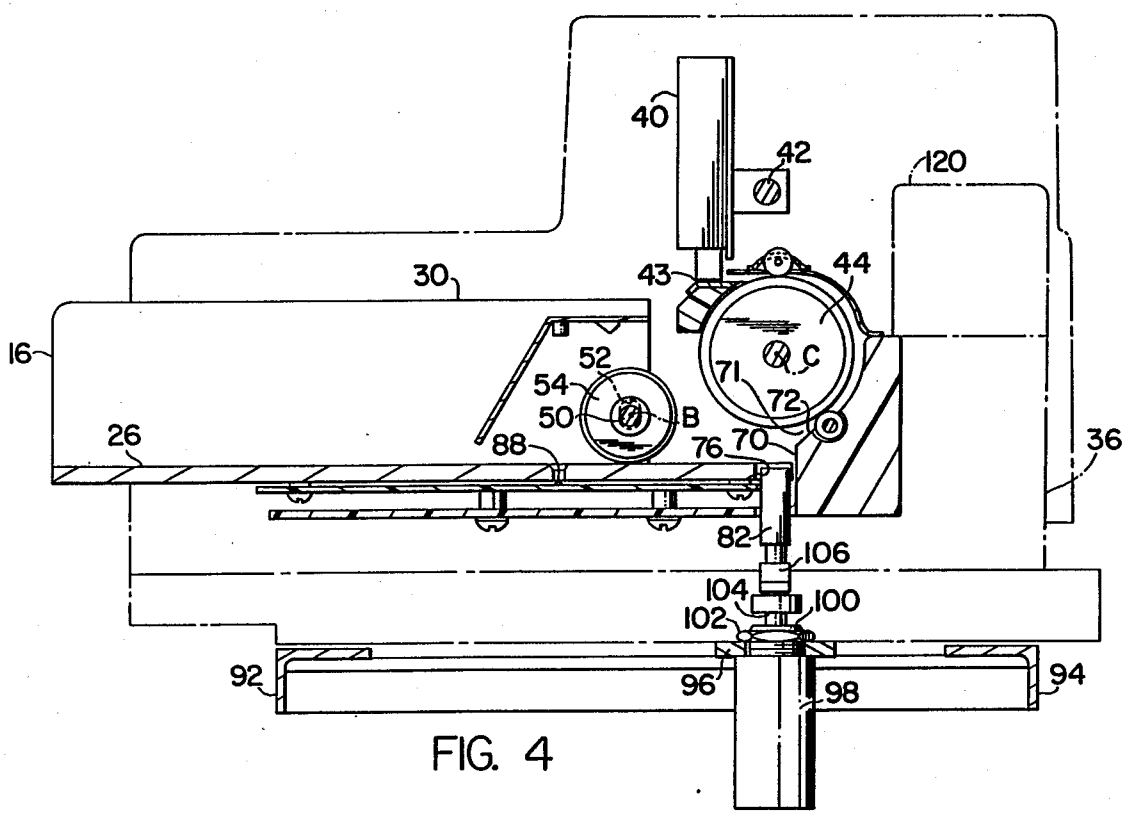
FIG. 4 is a vertical sectional view taken along line 4—4 of FIG. 2.

As shown in FIGS. 2, 3 and 4 the receiving surface 26 of the tray 16 is laterally bounded by two side walls 28 and 30 spaced from one another by a dimension A measured along the indicated X-coordinate direction, and this dimension A is preferably about 9½" so as to give the receiving surface a sufficient width to receive the largest of regular envelopes sizes acceptable by the postal service. The portion of the tray adjacent its outboard end 32 is supported by the base 12, and at its inboard end 33 the tray is supported by a portion of a printer housing 36 to maintain the tray in a substantially horizontal position. A printer 38, of which the housing 36 is a part, is located at the inboard end 33 of the tray 26. Various different known printers may be used, but preferably and in the illustrated case the printer 38 is an ink jet printer, such as one made by Hewlett Packard Company and referred to as a "Desk Jet Printer". This printer 38 has an elongated printing station 43 extending in the X-coordinate direction and includes an ink jet head 40 movable along the printer station 43 and guide a 42 in the X-coordinate direction by a belt drive, or the like (not shown), above feed rollers 44 rotatable about an axis C parallel to the X-coordinate direction. The receiving surface width A is substantially equal to or less than the maximum length of line capable of being printed by the printer, which means it is equal to or less than the length of the guide 42 on which the print head 40 travels. This feature is significant in that it enables the print head 40 to travel anywhere along the width dimension A to print data anywhere on the envelope 2 irrespective of the envelope width and its lateral position along the X-coordinate axis.

Referring now to FIG. 3, a feed means is provided and associated with the tray 16 for initially advancing the envelope 2 as it is inserted into the machine 10 by the user. This means includes a drive motor 46 drivingly connected by a belt 48, or other suitable drive means, to a drive shaft 50 supported for rotation about an axis B parallel to the X-coordinate direction. The ends of the shaft 50 are received within elongated openings 52 in each of the side walls 28 and 30, with each opening having its major axis disposed orthogonally to the receiving surface 26 to allow the shaft to move in a vertical plane. Positioned along the shaft 50, starting approximately ¾" away from each of the side walls 28, 30 and spaced approximately 2¾" apart thereafter, are drive wheels 54. Each drive wheel 54 has a through opening formed concentrically with its center and slightly greater in diameter than the outer diameter of the shaft 50 so that it can rotate freely on the shaft 50. Each wheel 54 further has a grooved periphery carrying on elastomeric tire or O-ring 58.

Adjacent each drive wheel 54 is an annular stop element 60 having a through bore receiving the shaft and a set screw rotatably fixing the stop to the shaft 50. As shown in FIG. 3, each wheel 54 has a side face engaging an adjacent side face of its associated stop element. A plurality of helical compression springs 68 are also received on the shaft 50. Each of these compression springs 68 is associated with a respective one of the wheels 54 and urges that wheel axially toward its associated stop 60. The frictional engagement between each wheel and its stop therefore creates a friction drive drivingly coupling the wheel to the shaft 50, and allowing the wheel to rotatively slip relative to the shaft when the driving load on the wheel exceeds a given value. Thus, when the shaft 50 is rotated each wheel 54 is likewise rotated through its frictional coupling at the same speed as the shaft until slippage occurs in the coupling due to an overload on the wheel.

As is shown in FIG. 4, the inboard end 33 of the receiving surface 26 terminates at an abutment means located along a line extending transversely of the receiving surface and against which an envelope is driven for the purpose of giving it a desired orientation of leading edge parallel to the printer guide 42 in the event of it not already having such orientation before reaching the abutment means. The abutment means may take various forms without departing from the broader aspects of the invention, and in the present case is shown to be a vertical abutment wall 70 having a constant height along its length and supported on the printer housing 36. This abutment wall 70 extends parallel to the X-coordinate direction, and therefore parallel to the printer guide 42, for a distance corresponding to the width A of the receiving surface 16. Therefore, it confronts the leading edge of an envelope 2 placed on the surface 26 for entry into the machine. The height of the wall 70 is approximately ¼" taken from the intersection between it and the surface 26. The wall 70 at its upper end meets with an inwardly and upwardly curved surface 72 defining a receiving space 71 between itself and the printer feed means. The printer feed means may vary depending on the particular printer used in the machine 10. Such means usually, however, consists of either one elongated feed roller or a plurality of rollers of shorter length driven about an axis parallel to the printer guide 42. In the case of the illustrated printer the feed means includes three feed rollers 44 driven about an axis C. The space 71 is designed so that an envelope leading edge may be moved against the rollers 44 to frictionally couple the envelope with the rollers 44 and thereby have it moved by the rollers toward the printing station defined by the guide 42.

As hereinafter described in more detail the wheels 54 in conjunction with their frictional couplings advance an input envelope until its leading edge encounters and becomes aligned with the wall 70. This alignment is detected and then the abutment means and the envelope are disengaged from one another to permit the envelope to move beyond the abutment means to the printing station. The means for effecting this disengagement may vary, but in the illustrated case it comprises essentially a lifting means operable to lift the leading edge of the envelope above the wall 70. The details of this lifting means may also vary, but in the preferred and illustrated embodiment portions of the receiving tray 16 are cut out to provide recesses 74, 76 and 78 (FIG. 3) along the inboard end 33 of the tray, and pusher elements 80, 82 and 84 are provided which normally have their top surfaces located coplanar with or below the receiving surface 26 and which are movable upwardly through the recesses 74, 76 and 78 to lift the envelope leading edge above the top of the wall 70.

For detecting the alignment of an envelope leading edge with the wall 70, at the inboard end of the receiving tray is a row of four laterally spaced photodetectors 86 located on a transverse line very close to the wall 70 and sensitive to light emitted by an associated light source (not shown) located above the receiving surface.

A second row of spaced photodetectors 88 are located on a line extending transversely of the receiving surface and are associated with openings formed in the receiving tray 16, these openings and photodetectors being preferably spaced approximately ¼" apart from one another along the full width A of the receiving surface. A suitable means (not shown) is also provided above the receiving surface 26 for directing light toward the photodetectors 88. The photodetectors 86 and 88 do not extend upwardly beyond the receiving surface 26 and therefore do not inhibit the free sliding of the work piece 2 across the surface 26.

Figure 5:
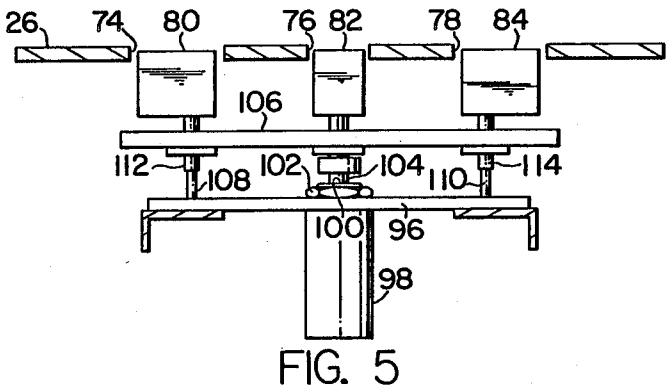
FIG. 5. is a fragmentary vertical sectional view of the lifting means of the machine of FIG. 1.

Returning to the lifting means for lifting the leading edge of an envelope over the wall 70, as shown in FIGS. 4 and 5 the printer housing 36 along with the receiving tray 16 is supported on the base 12 by transversely extending flanges 92 and 94 with an intermediate flange 96 being positioned between the outer flanges 92 and 94. A through bore is formed in the middle flange 96 and receives the threaded neck portion 100 of an actuator 98. The actuator 98 is attached to the flange 96 by a threaded nut 102 cooperating with the threaded neck portion 100 of the actuator 98 to position the actuator 98 at a fixed distance below the surface 26. The actuator 98 includes a moveable rod 104 gravity biased to its retracted (down) position. The end of the rod 104 oriented away from the actuator 98 is fixed to a carrier bar 106 movable between an uppermost position corresponding to the condition when the actuator 98 is energized, and a lowermost position corresponding to the condition when the actuator 98 is deenergized. Each of the pusher elements 80, 82 and 84 may be integrally formed with the carrier bar 106 or may be formed as separate elements and subsequently attached to the carrier bar 106 by suitable attachment means. Also, upwardly extending guide pins 108 and 110 are fixed to the flange 96 and cooperate with sleeves 112 and 114, depending from the carrier bar 106, and have inner diameters sufficient to receive the pins 108 and 110, respectively, in a sliding manner. Thus, the carrier bar 106 while being moved upwardly at its center by the rod 104 is also supported against lateral movement by the pins 108, 110 and the corresponding sleeves 112, and 114, thereby restraining movement of the carrier bar 106 strictly within a vertical plane. The actuator 98 is preferably an electromechanical solenoid type one.

In use of the machine 10 an operator first starts the machine, as by putting a coin or coins in the coin box 1. This among other things, starts the drive motor 46 to rotate the shaft 50. An envelope 2 is then placed on the receiving surface 26 and is slid by hand forwardly along the surface 26 until it engages the feed wheels 54 driven by the shaft 50. When an envelope is not positioned under any of the feed wheels its wheels are very slightly out of contact with the receiving surface 26. The shaft 50 being however received within the vertically elongated slots 52 moves upwardly, if necessary, when an envelope encounters one or more of the wheels to elevate the wheels a sufficient distance to accommodate the thickness of the envelope, and the wheels are at the same time biased by gravity against the envelope. The shaft 50 is rotated in such direction that the feed wheels through engagement with the envelope move it forwardly toward the abutment wall 70. To assist in this movement the receiving surface 26 is preferably formed of or coated with a low friction material, such as a hard plastic, thereby allowing the envelope to slide along the surface 26 with only a small amount of frictional resistance. In any event, the force required to slide the envelope over the surface 26 is less than necessary to cause slipping in any of the frictional couplings drivingly connecting the wheels 54 to the shaft 50.

It is a feature of the present invention that an envelope 2 when placed on the receiving surface 26 need not be placed perfectly square with respect to the indicated X and Y-coordinate directional axes, but instead may be placed on the surface somewhat crookedly, that is with its edges skewed relative to the X and Y axes. In FIG. 3 the envelope is shown to be skewed as it is pushed between the surface 26 and the feed wheels 54. The envelope 2 is thus moved forwardly toward the abutment wall 70 by the wheels 54 in this skewed condition until its leading edge hits the wall 70, as shown at 2'. Once in the position 2' the one feed wheel closest to the envelope's point of contact with the wall 70, in this case the wheel labeled D, will be unable to rotate at its normal speed, and slippage will occur in its frictional coupling with the shaft 50 to accommodate this. The other one or more of the feed wheels 54, labelled E, which engage the envelope will however be able to rotate at a faster speed than this one wheel D and will accordingly move the envelope so that it turns about its corner point of contact with the wall 70 until the entire leading edge of the envelope becomes aligned and in contact with the wall.

By energizing the actuator 98 when the envelope 2 is squarely abutting against the wall 70, the pusher elements 80, 82 and 84 are thrust upwardly beyond the surface 26 such that the leading portion of the envelope is thus also rammed upwardly beyond the top of the wall 70 and against the printer rollers 44. Consequently, the printer feed rollers 44 can then be rotated to advance the envelope toward the printing station 43 adjacent the guide 42 and the printer head 40. As mentioned, the printer 38 is of a known commercially available type and from the point at which the envelope is presented to the rollers 44 the feed of the envelope through the printer and the general operation of the printer takes place in a well known manner and need not be described in detail.

The controller 20 does not generate a signal to energize the pusher actuator 98 until it receives signals from the photodetectors 86 indicating that two adjacent photodetectors 86 have been covered by an envelope, this in turn being an indication that the leading edge of the envelope is aligned with the wall 70. As the pusher elements 80, 82 and 88 are moved upwardly through their respective recesses 74, 76 and 78, the leading portion of the involved envelope will overlie at least one of the recesses 74, 76, and 78 so that one or more of the associated pushers will drive the leading portion of the envelope into engagement with the printer rollers 44. Since at least one or more of the feed wheels 54 continue to engage the envelope, in the illustrated case the wheels E and D, the envelope is also urged forwardly while simultaneously being thrust upwardly. This causes almost instantaneous coupling of the envelope with the rollers 44 when the actuator 98 is energized and, as is discussed in more detail below, allows the controller 20 to determine with a high degree of accuracy the envelope height H as measured along the Y axis.

To determine the height H of an envelope 2 the controller 20 uses the driving signals or pulses supplied to a step motor 120, shown schematically in FIG. 4, which drives the feed mechanism of the printer 38, which in the illustrated case is the printer rollers 44, along with signals provided by the row of photocells 88. The dimension F in FIG. 3 is the fixed distance between the abutment wall 70 and the row of photocells 88, and preferably is between two and two and a half inches. The controller 20 therefore can and does calculate the height H of any envelope having a height greater than the distance F by counting the number of driving pulses supplied to the step motor 120 to rotate the rollers 44, after the pusher is operated, until the trailing edge of the envelope passes forwardly sufficiently to uncover all of the photodetectors 88, thereby signaling that the trailing edge of the envelope is located at the row of photodetectors 88 and at the distance F from the wall 70. Using, for example, a step motor 120 having 1000 steps per linear inch of envelope movement, if the controller senses 500 steps between the time the pusher means is actuated and the time the trailing edge of the envelope reaches the row of photodetectors 88, it will convert this step count into a value representing a linear advancement of ½", and will then add this advancement to the fixed distance F to arrive at the height dimension H for the involved envelope. The row of photodetectors 88 also provides signals to the controller 20 allowing the controller to determine the width W of an inserted envelope and its lateral position on the receiving surface 26 after the leading edge of the envelope has been aligned with the wall 70, as indicated by two adjacent ones of the photodetectors 86 giving an indication of being covered by the envelope. The width determination is made by interrogating the photodetectors 88, and preferably is done by counting the number of photodetectors 88 giving an indication of being covered by the envelope and by then multiplying this number by the fixed spacing, preferably ¼ inch, between the photodetectors to yield the envelop width W. The lateral position determination is in turn made by sensing the number of uncovered photodetectors 88 located to the right of the right edge of the envelope.

Figure 7:
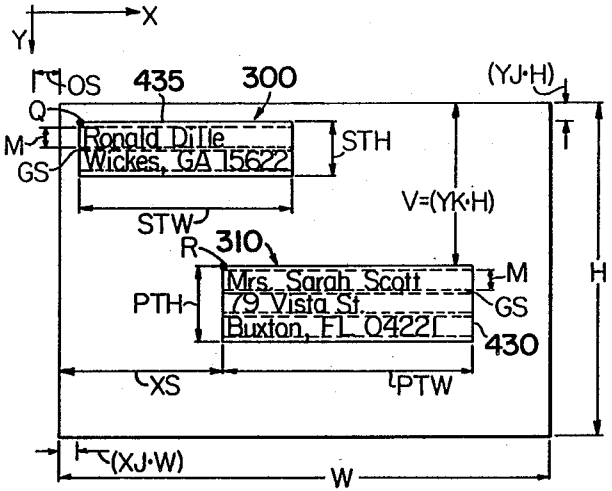
FIG. 7 is a top plan view of an envelope after having a mailing and a return address printed on its face by the machines of FIG. 1.
Figure 6A:
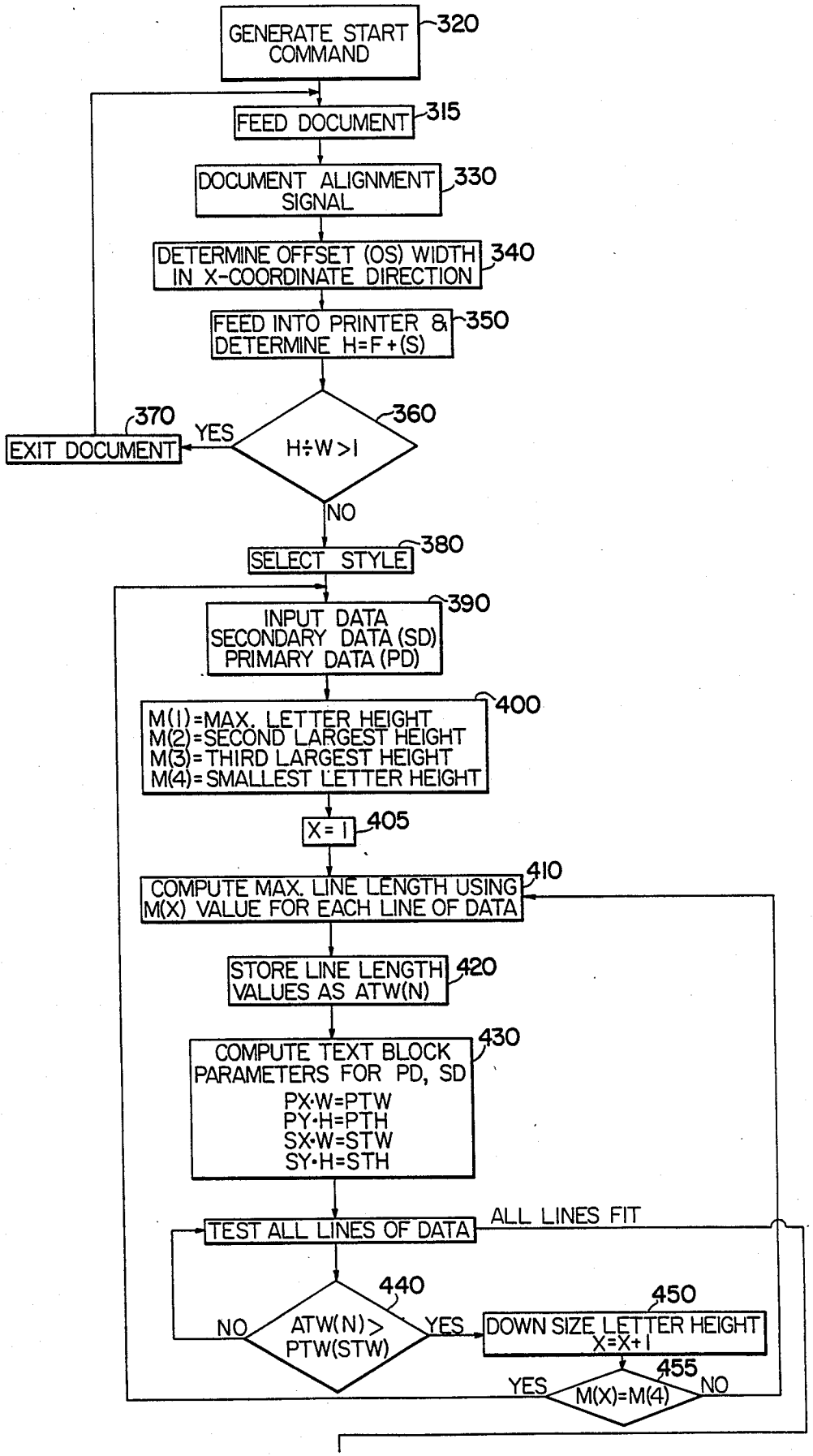
FIGS. 6*a* and 6*b* taken in combination depict a flow chart illustrating the method of selecting character size and of arranging the lettering on an envelope face.
Figure 6B:
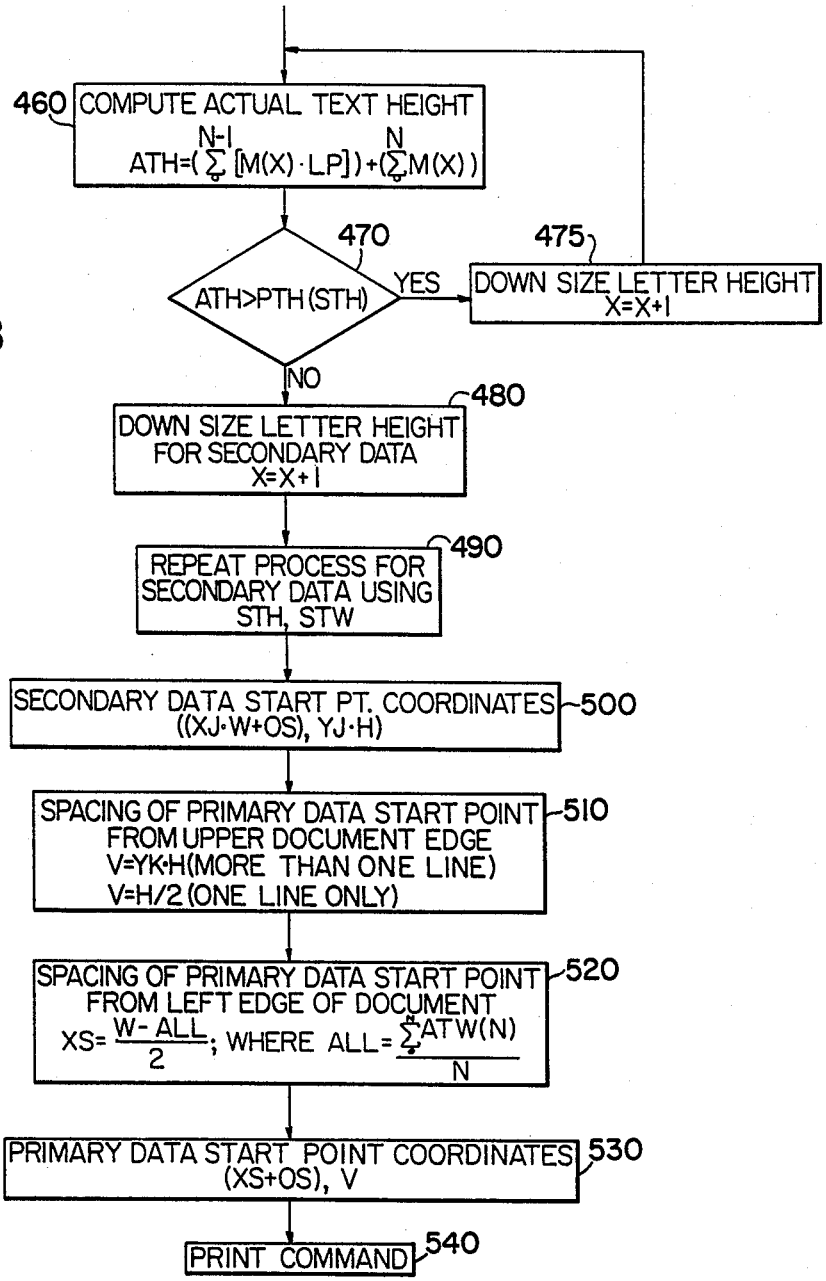

Referring now to FIGS. 6 and 7, the method for operating the machine 10 to create a desired printing on a work piece is illustrated. As previously discussed, the work piece is usually an envelope for receiving a greeting card, invitation or the like. Therefore, the information to be printed on the envelope usually includes a return address, indicated at 300, and a mailing address, indicated at 310. In FIG. 7 the illustrated lettering style is one of a number of differing styles made available for choice by the user by a number of character fonts stored in the memory of the controller 20.

The operator begins the sequence of steps leading ultimately to the printing of graphic information on an envelope by generating a start command received by the controller 20. This start command can, for example, be produced when a sufficient number of coins are inserted into the slot of the coin box 1. The start command energizes the drive motor 46 to rotate the feed wheel shaft 50. The operator then places an envelope on the surface 26 and slides it along this surface (step 315) until one or more of the feed wheels 54 engage and move the envelope forwardly toward the abutment wall 70 and eventually into aligned engagement with the wall 70. An alignment indicating signal is then produced by the photodetectors 86 (step 330). A calculation is then made by the controller to determine the width W of the envelope by counting the number of photodetectors 88 indicating a covered condition. At the same time, the controller 20 determines the envelope's lateral position, or offset OS, by counting the number of uncovered photodetectors existing between the right edge of the receiving surface and the right edge of the envelope. This lateral position information is used to control the operation of the printer head 40 so that the printing appears in proper relation to the right edge of the envelope, that is the right edge of the envelope as it is fed face down into the machine 10, and which becomes the left edge of the envelope when viewing its face as in FIG. 7.

The height H of the envelope is then calculated, as previously mentioned, by counting the number of step motor steps S needed to rotate the printer roller 44 to bring the envelope trailing edge to the row of photodetectors 88, by multiplying this count by the linear advancement associated with each step, and by then adding the distance value so obtained to the fixed distance F (step 350).

The controller 20 next determines whether the envelope has been properly inserted into the machine 10, that is with a long edge as the leading edge, by dividing the height dimension H by the width dimension W and then determining whether this ratio is greater than 1 (step 360). If this ratio exceeds 1, the controller will advance the envelope through the printer without printing taking place (step 370) so that it may be reinserted into the machine with the correct placement (long edge leading).

If the ratio is 1 or less than 1 the controller recognizes the envelope as having a proper placement, and the user is then instructed by a display imaged on the CRT screen 24 to select a letter style from a menu of different style types (step 380). In addition, the user is then requested to input, using the keyboard 22, the return address data 300 as well as the mailing address data 310 (step 390). For purposes of this discussion, the mailing address data 310 will hereinafter be referred to as primary data (PD) and the return address data 300 will hereinafter be referred to as secondary data (SD). Within the memory of controller 20 each available style or font of characters is stored at a number of different character sizes one of which sizes is selected by the controller for the characters to be printed on the envelope at hand. Each character size is designated by a height value M(X) equal to the height of the tallest characters of that size. By way of example, in the illustrated case the character sizes provided for each style or font of characters may be taken to be as follows:

| Relative Size | Size Designation (Height Value) | Height of Tallest Character |
|---|---|---|
| Largest Character Size | M(1) | 0.300" |
| Second Largest Size | M(2) | 0.250" |
| Third Largest Size | M(3) | 0.200" |
| Smallest Size | M(4) | 0.150" |

The controller 20 first selects the largest character size M(1) at step 400 and computes the length of each entered line of primary data using the M(1) size (step 410). The computation at step 410 may be performed by the character spacing method disclosed in U.S. Pat. No. 4,591,999 issued to the inventor of the present application, and which patent is herein incorporated by reference. This patent discloses how line lengths can be computed automatically by a microprocessing unit using a described intercharacter spacing routine. The length of each line of primary data is then temporarily stored at N number of locations ATW(N), where N is the number of lines of primary data (step 420.)

The primary and the secondary data are intended to fit into imaginary text blocks having widths PTW and STW and text heights PTH and STH, as shown in FIG. 7. The dimensions PTW and PTH of the imaginary text block 430 and the dimensions STW and STH of the imaginary text block 435 are determined by the controller by multiplying the measured envelope dimension W by predetermined percentage values PX and SX, respectively, to derive PTW and STW and by multiplying the measured envelope dimension H by predetermined percentage values PY and SY, respectively, to derive PTH and STH.

The lines of primary and secondary data are required to fit within the imaginary text blocks 430 and 435. To see to this the controller first acts on the primary data 310 to determine if any one of the lines comprising this data exceeds the block width PTW if the lines are printed at the largest character size M(1). To do this, as shown in step 440, each of the values representing the lengths of the lines of primary data stored at locations ATW(N) is tested against the width value PTW to determine if any of these lines has a length greater than PTW. If one of these lines does exceed the PTW value, the microprocessor then downsizes the letter size M(1) currently used to the next smaller letter size M(2) and again calculates the lengths of various lines (at step 410). Then returning to step 440 the new line lengths are tested against PTW, and, if necessary, the downsizing procedure is then again repeated. If when using the smallest letter size M(4) one of the lines of text still has a length exceeding PTW the controller 20 will display a message to the operator indicating that the particular line in question should be reentered in a shortened form (step 455).

Once the controller in using a given character size determines that all lines of the primary data will fit within the width PTW of text block 430, it next calculates the actual text height of the primary data PD, that is the combined height of all lines and interline spacings or gaps, and it then compares this value with the previously computed imaginary text block height PTH to determine if the actual text height exceeds PTH. This is accomplished by first calculating the actual text height of the primary data 310 using the letter size currently retrieved from the storage location 400 as a result of the most recently made line length calculations and comparisons. To make this calculation the height M of each line must be included as well as the height of the gap, indicated at GS, existing between each pair of lines. The height GS is determined by multiplying a predetermined percentage value, represented as LP in step 460, by the height value M(1), M(2), M(3) or M(4) currently retrieved from storage location 400. Then, this value GS is multiplied (N−1) times, where N is the number of lines, to yield a value equalling the total height of all the spaces existing between the lines of primary data. To account for the character height contribution to the actual text height, the value M(1), M(2), M(3) or M(4) currently representing the letter size is multiplied by N. Then, by adding the total of the letter character to the total of the spacing heights an actual text height value ATH is determined as given by the following equation:

$$ATH=(N-1)[M(x)\cdot LP]+[N\cdot M(x)]$$

Subsequently, at step 470, the text height ATH of the primary data is compared with PTH (step 430). If the actual text height ATH does exceed PTH, the controller will again downsize the letter size to the next size. Using the smaller letter size, the actual text height ATH is recomputed and compared with PTH. If after using the smallest letter size M(4) the actual text height still exceeds PTH a prompt message is displayed by the controller asking the operator to reenter the primary data in such fashion as to reduce the text height, as by using a smaller number of lines.

Once it has been determined that the actual text height of the primary data 310 will fit within the height PTH of the imaginary text block 430, the controller then conducts the same analysis of text width and height for the secondary data 300 to ensure it will fit within the imaginary text block 435 (step 490). If no secondary data has been entered at step 390, the controller 20 will simply proceed to step 500 and begin the centering calculation discussed later. However, in the case where secondary data has been entered, the controller 20, before going any further will, if possible, automatically reduce the letter size currently being used to the next lower size (step 480) since it is desirable to print a return address, that is the secondary data 300, with smaller lettering than that used for the mailing address or primary data 310. But, if at step 480 the letter size currently being used is already the smallest available one, the line length computations (step 410) and the text height computations (step 460) will be made using the smallest letter size M(4).

After it is determined that both the primary data 310 and the secondary data 300 will fit, respectively, within the imaginary text blocks 430 and 435, the controller proceeds to locate each of the text blocks 430 and 435 with respect to the height H and the width W dimensions of the envelope. Since the return address or secondary data 300 is normally positioned tightly within the upper left hand corner of the envelope, positioning of this data block is accomplished by orienting the upper left corner of the block 435 at (X,Y) coordinates equal to [(XJ·W+OS), (YJ·H)] wherein the values XJ and YJ are predetermined percentages which, when multiplied by the corresponding width W and height dimensions H, create a dual axis starting point Q from which the printer head 40 will begin printing this data (step 500). Note that the X-coordinate point is additionally spaced from the origin by the amount OS which value represents the lateral offset of the side edge of the envelope from the origin represented by the right side wall 28 of the tray 16.

In positioning the primary text block 430 on the envelope face, the distance along the height dimension H from the envelope upper edge is calculated simply by multiplying a predetermined percentage YK by the envelope height H to arrive at the Y-coordinate of the starting point R at which the printer head 40 will begin printing the primary data 310 (step 510). As an exception to this however, if the primary data consists of only one line of text this one line is preferably centered vertically of the envelope face, that is spaced a distance equal to H/2 from the top edge of the envelope.

In determining the lateral positions of the primary text the average line length ALL is first calculated by summing the length of the lines making up the primary text, and by then dividing the sum so obtained by the number of lines. The average line length is then substracted from the width W of the envelope and the result divided by two to obtain the spacing XS of the starting point R from the left hand edge of the envelope (step 520). The coordinates of the starting point R are then derived by adding the offset OS to the spacing XS (step 530).

Once this data has been arranged within the storage facilities of the controller 20, the controller 20 requests the operator to instruct it to print the inputted data by pushing an appropriate print button (step 540). After receiving a "print" command, the controller 20 instructs the stepping motor 120 to rotate the printer feed rollers 44 and thereby move the envelope in the indicated Y-coordinate direction while simultaneously instructing the print head drive motor (not shown) to move the printer head 40 along the guide 42, and also instructs the print head itself, such that the combination of movements between the rollers 44 and print head 40, together with the energization of the print head produces graphic information in the selected character style at the precalculated positions on the envelope face.

In summary, it should be understood that the character size of the primary data 310 and of the secondary data 300 is selected by a process of trial and error from an array of various different character sizes, with the trial and error process involving the testing to see whether the data if printed at a selected character size would fit within an imaginary block or blocks having dimensions proportional to the height and width of the involved envelope. While the character style used in the preferred embodiment is shown as calligraphy, it should be understood that the stored fonts providing a selection of different styles can also include other styles such as a plain block lettering style. Therefore, the present invention has been described by way of example rather than limitation.

I claim:

1. A calligraphy machine for printing text on generally rectangular work pieces, said machine comprising:

a printer having a printing station at which characters may be printed on a work piece in various different selectable sizes, means for inputting data defining the text to be printed on a work piece by said printer, means for receiving a work piece at a point remote from said printing station, feeding means for feeding a work piece from said remote point to said printing station, measuring means for automatically measuring the height and width of a work piece as it is fed by said feeding means from said remote point to said printing station, and means responsive to the work piece height and width measurement made by said measuring means for controllably selecting the size of the characters printed on a work piece by said printer in dependence on said height and width measurements.

2. A calligraphy machine as defined in claim 1 further characterized by:

means for determining the lateral position of a work piece relative to said printing station prior to its being printed on by said printer, and means for locating the text to be printed on said work piece in accordance with both the lateral position determination made by said lateral position determining means and the height and width measurements made by said measuring means.

3. A calligraphy machine as defined in claim 2 further characterized by:

said feeding means being operable to feed a work piece along a feed path extending generally perpendicular to said printing station and throughout which path a work piece may have any lateral position relative to said printing station within a given range of such lateral positions, and said lateral position determining means being means for sensing the lateral position of a work piece relative to said printing station.

4. A calligraphy machine as defined in claim 3 further characterized by:

means for orienting a work piece as it is moved along said path to assure that the leading edge of said work piece extends perpendicular to said path when it reaches said printing station.

5. A calligraphy machine as defined in claim 4 further characterized by:

said means for orientating a work piece including an abutment means located along a line extending transversely of said feed path against which the leading edge of a work piece is driven by said feeding means, said feeding means being thereafter operable in conjunction with said abutment means to move the leading edge of the work piece into alignment with said line along which said abutment means is located, and means for moving said work piece and said abutment means out of disengagement with one another after said leading edge of a work piece becomes aligned with said abutment line to allow said work piece to advance beyond said line toward said printing station.

6. A calligraphy machine as defined in claim 1 further characterized by:

said feeding means being operable to feed a work piece along a feed path extending generally perpendicular to said printing station, and said measuring means including a row of closely spaced photodetectors located on a line extending transversely across said feed path and which plurality of photodetectors are interrogated as a work piece passes over them to determine the width of said work piece.

7. A calligraphy machine as defined in claim 1 further characterized by:

said feeding means including a step motor and means driven by said step motor for advancing a work piece a given distance in response to each step of said step motor, and means for counting the number of steps of said step motor executed in moving said work piece from a position at which its leading edge is aligned with a given point in its path a movement from said remote point to said printing station and a position at which the trailing edge of said work piece is aligned with a given point located along said path of movement.

8. The method for printing on a generally rectangular work piece, which method comprises the steps of:

providing a work piece, providing a printer having a printing station at which characters may be printed on said work piece in various different selectable sizes, providing data defining text to be printed on said work piece by said printer, moving said work piece from a point remote from said printing station along a feed path toward said printing station, as said work piece is moved along said feed path automatically measuring its height and width, selecting a character size in accordance with said height and width measurements, and operating said printer to print said text on said work piece at said selected character size after said work piece reaches said printing station.

9. The method defined in claim 8 further characterized by:

determining the lateral position of said work piece relative to said printing station prior to its being printed on by said printer, and locating the text to be printed on said work piece in accordance with both the determined lateral position of said work piece and the height and width measurements made of said work piece.

10. The method defined in claim 8 further characterized by:

said printing station being elongated in the direction perpendicular to said feed path, and as said work piece is moved along said path orienting it so that its leading edge is arranged parallel to said printing station when it reaches said printing station.

11. The method defined in claim 10 further characterized by said step of orienting said work piece being carried out by providing an abutment means located along an abutment line extending transversely of said feed path, driving said leading edge of said work piece against said abutment means to cause said leading edge to become aligned with said abutment line, and then disengaging said abutment means from said work piece and moving said work piece beyond said abutment means towards said printing station.

12. The method of claim 8 wherein said printing station is elongated, said measured width of said work piece is its dimension parallel to said printing station and said measured height of said work piece in its dimension perpendicular to said printing station, and further characterized by the steps of:

comparing said measured width to said measured height, and if as a result of said comparing step said measured height is found to be greater than said measured width moving said work piece past said printing station without operating said printer to print on it.

13. In a calligraphy machine, the combination comprising:

means providing a receiving surface for receiving a generally rectangular work piece, said receiving surface having first and second ends;

feed means supported adjacent said receiving surface between said first and second ends for engaging and moving a work piece forwardly along said surface toward said second end;

an abutment means located on an abutment line extending transversely across said receiving surface at said second end thereof and projecting upwardly beyond said receiving surface to provide an abutment against which the leading edge of said work piece is driven by said feed means;

said feed means being operable in cooperation with said abutment means to align the leading edge of said work piece with said abutment means in the event said leading edge first contacts said abutment means in a skewed condition; and means for disengaging said work piece from said abutment means after the leading edge of said work piece is aligned with said abutment line to allow said work piece to be moved forwardly beyond said abutment line.

14. The combination defined in claim 13 wherein said receiving surface is substantially horizontal; and said feed means includes a rotatable shaft disposed parallel with and above said receiving surface and having feed wheels spaced along its length to engage a work piece to move it forwardly toward said second end of said receiving surface.

15. The combination defined in claim 13 wherein said receiving surface is substantially horizontal; and said feed means includes a rotatable shaft supported for rotation above and parallel to said receiving surface;

a plurality of wheels each carried by said shaft for rotation relative thereto; and a frictional drive means drivingly coupling each of said drive wheels to said shaft so that each wheel rotates with said shaft until a given load is imposed on said wheel after which said wheel slips relative to said shaft.

16. The combination defined in claim 15 wherein said frictional drive means includes an annular stop element associated with each of said drive wheels and fixed to said shaft, and spring means for urging each drive wheel axially of said shaft into frictional engagement with its associated stop element.

17. The combination defined in claim 13 wherein said receiving surface is generally horizontal and is part of a receiving tray, and said receiving tray includes side walls extending upwardly from said receiving surface along the side edges of thereof; and said shaft has opposite end portions received in elongated openings in each of said side wall to permit said shaft and said feed wheels to move upwardly to accommodate work pieces of different thicknesses.

18. The combination defined in claim 13 further characterized by a sensing means for sensing the alignment of a work piece leading edge with said abutment line, and means responsive to said sensing means for operating said disengagement means when said sensing means detects the alignment of a work piece leading edge with said abutment line.

19. The combination defined in claim 13 wherein said sensing means includes a row of photodetectors located on and spaced from one another along a line parallel and closed to said abutment line.

20. The combination defined in claim 13 further characterized by a sensing means operable after said leading edge of a work piece is aligned with said abutment means for sensing the width and lateral position relative to said receiving surface of said work piece.

21. The combination defined in claim 20 wherein said sensing means is a row of photodetectors located on and closely spaced from one another along a second line extending transversely across said receiving surface parallel to said abutment line, said second line in the direction of feed of said feed means being located a substantial distance in advance of said abutment line.

22. The combination defined in claim 21 wherein said abutment means is an abutment wall extending upwardly beyond receiving surface, and said means for disengaging a work piece from said abutment means is a lifting means for lifting the leading portion of a work piece above said abutment wall.

23. The combination defined in claim 22 wherein said lifting means includes recesses formed in said receiving surface adjacent said abutment wall, a plurality of pusher elements each located respectively in one of said recesses and each having an upper surface moveable between a lowermost retracted position wherein said upper surfaces is positioned below said receiving surface and an uppermost position wherein said upper surface is located above the top of said abutment wall, and an actuator positioned below said support surface and having a moveable rod connected with a carrier bar, said pusher elements being fixed on said carrier bar at spaced apart distances from one another such that each of said pusher elements is oriented in alignment with its associated recess formed in said receiving surface.

24. The combination defined in claim 13 further characterized by a printer having a printing station;

means for feeding a work piece to said printing station after it is disengaged from said abutment means; and means for measuring the height of said work piece as its leading edge is moved beyond said abutment line and toward said printing station.

25. The combination defined in claim 24 wherein said means for feeding a work piece to said printing station is driven by a step motor; and said means for measuring the height of said work piece includes means for counting the number of steps executed by said step motor in moving said work piece from a position at which its leading edge is aligned with a given point to a position at which its trailing edge is aligned with a given point.

26. The combination defined in claim 25 further characterized by a row of photodetectors located on and closely spaced from one another along a second line extending transversely across said receiving surface parallel to said abutment line, said second line in the direction of feed of said feed means being located a substantial distance in advance of said abutment line, and said means for measuring the height of said work piece including means for counting the number of steps executed by said step motor in moving said work piece from the position at which its leading edge is aligned with said abutment line to the position at which its trailing edge is aligned with said row of photodetectors.

27. The combination defined in claim 26 further characterized by means for interrogating said row of photodetectors after the leading edge of said work piece is aligned with said abutment line to determine the width and lateral position of said work piece.

28. The combination defined in claim 27 further characterized by means for comparing the measured height of said work piece with the measured width of said work piece and for advancing said work piece through said printer without printing in the event said measured height is found by said comparing means to be greater than said measured width.

29. A method of arranging printed text on a work piece comprising the steps of:

providing a generally rectangular work piece;

providing data defining text to be printed on said work piece;

providing a printer capable of printing text on said work piece at any selected one of a number of different character sizes;

determining the width and the height of said work piece;

determining an imaginary text block size for the text defined by said data by using as the width and height of said imaginary text block predetermined percentages of the workpiece width and height;

utilizing the largest of said different character sizes to compute the line length of each line of said text;

comparing each of said line lengths to the width of said imaginary text block;

if each of said line lengths is equal to or less than said width of said imaginary block, using said largest character size in the further preparation of said data for printing on said work piece, and if one of said line lengths is longer than said width of said imaginary block, selecting the next smallest of said character sizes and repeating the steps of computing line lengths and of comparing such line lengths to the width of the imaginary block until all of the line lengths are found to be equal to or shorter than the width of said imaginary block, and then using the then involved character size in the further preparation of said text for printing on said work piece.

30. A method as defined in claim 29 further comprising the steps of calculating the height of said text after all the actual line lengths have been found to be equal to or less than the width of said imaginary block using the then involved character size, comparing said height of said text with said height of said imaginary block, if said text height is equal to or less than said imaginary block height, continuing with the preparation of said text for printing, and if said text height is more than said imaginary block height selecting the next smaller one of said character sizes and repeating said step of calculating said text height and said step of comparing said text height to said imaginary block height.

31. A method as defined in claim 30 wherein the step of calculating the height (ATH) of said text is defined by the equation;

$$ATH=(N-1)[M(x)\cdot LP]+[N\cdot M(x)]$$

wherein M(x) is the character size, expressed as the height of the tallest characters, currently selected from said plurality of sizes;

LP is a predetermined percentage value; and

N is the number of lines of data.

32. A method for arranging data on a work piece comprising the steps of:

providing a generally rectangular workpiece;

providing primary and secondary data defining respectively primary and secondary texts to be arranged on said work piece;

determining imaginary text blocks for each of said primary and secondary text having width and height dimensions based on different percentages of the width and height of said work piece;

determining a character size which will allow said primary text when printed at said character size to fit within the imaginary text block determined for said primary text, and determining a character size no greater than the character size determined for said primary data which will allow said secondary text to fit within the imaginary text block determined for said secondary text.

33. A method as defined in claim 32 further comprising the steps of:

positioning the left edge of the text block for the secondary text at a spacing from the left edge of said work piece which spacing is determined by multiplying by the work piece width by a given percentage value; and positioning the top edge of said secondary data text block at a spacing from the top edge of said work piece which spacing is determined by multiplying the work piece height by a given percentage value.

34. The method as defined in claim 32 further comprising the step of positioning the upper edge of the text block for the primary text at a spacing from the top edge of the work piece, which spacing is equal to a given percentage of said work piece height if the number of lines of said primary text is greater than one.

35. A method as defined in claim 32 further comprising the steps of locating the line of text at the vertical mid point of said work piece if said primary text consists of only one line.

36. The method as defined in claim 32 further comprising the steps of:

determining the average length of the lines of primary text;

subtracting said average line length from the width of said work piece and dividing the result by two to obtain a spacing value; and spacing the left hand edge of said primary text from the left edge of said work piece by said spacing value.

* * * * *